United States Patent [19]

Rothschild

[11] 4,316,333

[45] Feb. 23, 1982

[54] SEPARABLE FASTENER FOR REMOVABLE FOOT SUPPORTS

[75] Inventor: Harvey Rothschild, Kihei, Hi.

[73] Assignee: Featherspring International Corporation, Seattle, Wash.

[21] Appl. No.: 98,310

[22] Filed: Nov. 28, 1979

[51] Int. Cl.[3] ..... A43B 11/00; A43B 7/22

[52] U.S. Cl. ..... 36/50; 36/91; 2/DIG. 6

[58] Field of Search ..... 2/DIG. 6; 36/91, 100, 36/101, 80, 81, 82, 62, 50

[56] References Cited

U.S. PATENT DOCUMENTS

| | | | |
|---|---|---|---|
| 2,292,556 | 11/1942 | Whitman | 36/71 |
| 3,099,884 | 8/1963 | Kixmiller et al. | 36/101 |
| 3,686,779 | 8/1972 | Sachs | 36/101 |
| 3,984,926 | 10/1976 | Calderon | 36/71 |

FOREIGN PATENT DOCUMENTS

| | | | |
|---|---|---|---|
| 585532 | 3/1977 | Switzerland | 36/91 |

*Primary Examiner*—Patrick D. Lawson
*Attorney, Agent, or Firm*—Clement and Ryan

[57] ABSTRACT

A separable fastener device adapted for use in securing a removable foot support device to an internal portion of a shoe. The separable fastener device is comprised of two engaging elements. Each engaging element has a flexible planar base sheet of resilient material wherein one side of each sheet has a pressure responsive adhesive whereby one engaging element is attached to the removable foot support device and the other engaging element is attached to an internal portion of the shoe. Each of the engaging elements has a remaining side providing releasably interengageable mating surfaces in which one engaging element has a surface comprising flexible resilient hook members and the other engaging element has a surface comprising a loosely arranged mat of interlocking hair-like threads. These releasably interengageable mating surfaces engage when the foot support device is positioned in the shoe thereby preventing slippage of the foot support device. However, the foot support device may easily be removed from the shoe when desired by applying a force to the foot support device to cause yielding of the hook members thereby disengaging the hook members from the loosely arranged mat.

8 Claims, 6 Drawing Figures

SEPARABLE FASTENER FOR REMOVABLE FOOT SUPPORTS

TECHNICAL FIELD OF INVENTION

This invention relates to a separable fastener device used in securing a removable foot support device to an internal portion of a shoe, and more particularly using a separable fastener device having two engaging elements each having a side providing releasably interengageable mating surfaces that engage upon pressing these surfaces together thereby preventing the removable foot support device from slipping from a desired position yet permitting easy removal of the foot support device from the shoe by pulling the mating surfaces apart.

One of the mating surfaces of an engaging element of the fastener device used in this invention preferably has a plurality of flexible hook members and the other engaging element preferably has a mating surface which has a loosely arranged mat of interlocking hair-like threads. These interengaging mating surfaces are incorporated in fasteners commercially identified by the trademark "Velcro" wherein one mating surface will define a plurality of flexible hook members which interengage with another mating surface having loops or matted filamentary members. Such fastener devices have for many years been used with clothing, handbags, footware, curtains and other articles as a substitute for snaps, slide closing devices, buttons and other fasteners where flexibility, invisibility and easy operation are necessary, but despite these advantages have for some reason never been used in solving the long present problem of securing a removable foot support device to an internal portion of a shoe.

BACKGROUND ART

In the past when a foot support device such as a metatarsal support, heel lift or arch support tended to slip from a desired position inside a shoe, attempts were made to affix the support device to the shoe or to improve the frictional characteristics between the support and the shoe. Typically, the support device was affixed to the shoe by glue or double backed pressure sensitive tape. Alternatively, frictional characteristics were improved between the support device and the shoe by use of rubber layers having serrations or other protruberances.

Each of the above methods of fastening had some limitation. The use of glue or double backed pressure sensitive tape required the foot support device to remain in the shoe. If the foot support device was removed it would have to be re-glued or new pressure sensitive tape would have to be applied because the old tape would become encoated with fabric fibers and/or dirt and would cease to function. The rubber layer having serrations or other protruberances tended to lose frictional capabilities due to dirt and/or perspiration.

A leather pocket device has been used by gluing the pocket into the shoe wherein the foot support device could be inserted. This method of fastening involves gluing a leather pocket into the shoe thereby requiring the pocket to remain in the shoe unless the user wished to have to re-glue the pocket device after it had been removed.

DISCLOSURE OF THE INVENTION

The present invention provides a separable fastening device adapted for use in securing a removable foot support device to an internal portion of a shoe. The separable fastener device is comprised of two engaging elements in which each element has a flexible planar base sheet of resilient material wherein one side of each sheet carries a pressure responsive adhesive. One engaging element is attached to the removable foot support device and the other engaging element is attached to an internal portion of the shoe by means of this adhesive.

Each of these engaging elements has another side providing releasably interengageable mating surfaces in which one engaging element preferably has a surface comprising flexible resilient hook members and the other engaging element preferably has a surface comprising a loosely arranged mat of interlocking hair-like threads. These releasably interengageable mating surfaces mechanically engage when the foot surface device is positioned in the shoe. This mechanical engagement prevents slippage of the foot support device yet provides easy removal of the foot support device from the shoe when desired. The foot support device may be removed by applying a force to this support device which in the preferred embodiment causes yielding of the hook members thereby disengaging the hook members from the loosely arranged mat.

This invention has the advantage of allowing a particular foot support device to be easily used in a number of different shoes. As long as an engaging element of this fastener is disposed in a particular shoe that has a compatible mating surface as the engaging element affixed to a foot support device that support device may be secured into the shoe. This could reduce the number of foot support devices that a person would need compared to the number needed when the method for securing the foot support device is by more permanent means of gluing or taping.

A preferred embodiment of this invention affixes the engaging element having the loosely arranged mat of hair-like threads for a mating surface to the internal portion of the shoe. This allows the shoe to be worn in comfort without the foot support device because the matted mating surface is relatively soft. The wearer can also use the shoe without the foot support device without having to reglue or retape the support device when it is needed. A further advantage of this preferred embodiment is that the engaging element having the hook members is a little more expensive than the engaging element having the matted mating surface; since there is need for only one engaging element having the hook members for each foot support device, this leaves the less expensive engaging member disposed in a multiple number of shoes.

Another advantage of this invention is that it utilizes a mechanical engagement. Unlike rubber frictional devices previously discussed, the mechanical engagement of this invention is relatively unaffected by dirt, perspiration or fabric fibers.

This invention has several advantages over the previously discussed "Holdit" leather pocket device which is glued to the shoe. The planar sheet characteristic of the separable fastener device makes it less visible than the leather pocket device, particularly when there is a need to secure a foot support device in an open heeled shoe. Furthermore, the leather pocket device must be more precisely positioned and is more expensive than the engaging elements of the present invention.

BRIEF DESCRIPTION OF THE DRAWINGS

The drawings illustrate the best mode presently contemplated for carrying out the invention.

In the drawings.

BEST MODE FOR CARRYING OUT THE INVENTION

Figure 1:
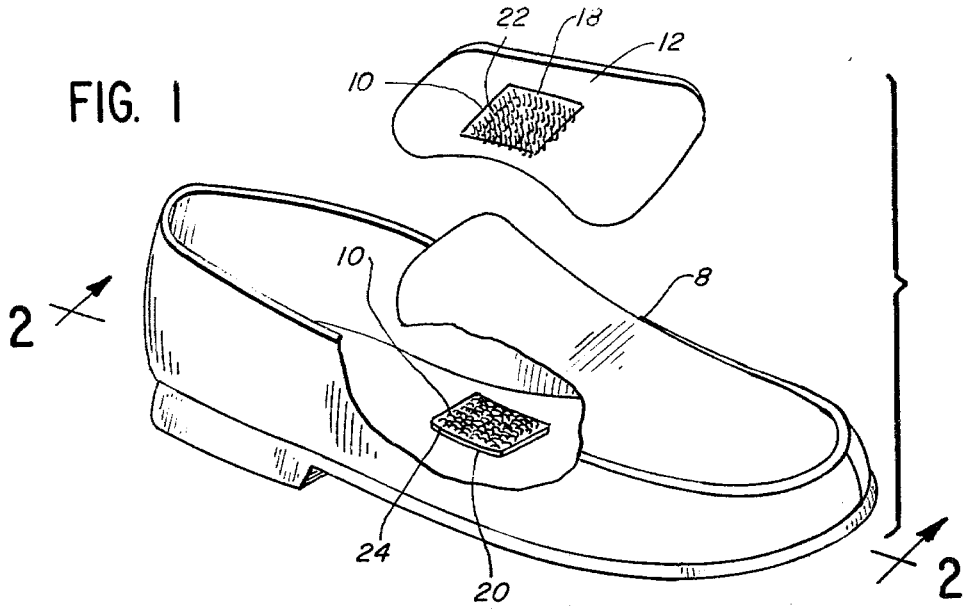
FIG. 1 is an exploded and partially cut away perspective view of the separable fastener device adapted for use with an arch support and shoe.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

The precise shapes and sizes of the components herein described are not essential to the invention unless otherwise indicated, since for the purposes of illustration the invention is described with reference to an embodiment which is simple and straightforward.

The choice of materials is dependent upon the particular application involved and other variables, as those skilled in the art will appreciate.

Figure 2:
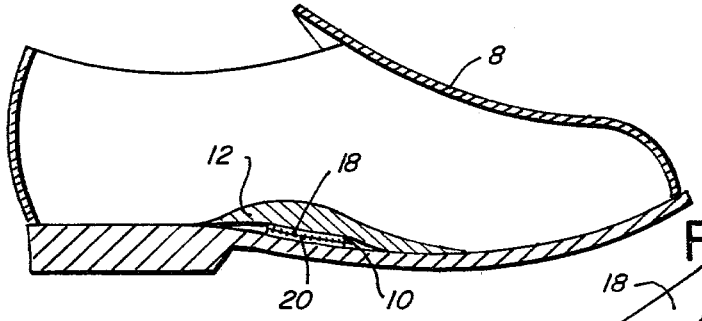
FIG. 2 is a cross-sectional view of the assembled apparatus of FIG. 1 taken substantially along the line 2—2 in FIG. 1.
Figure 3:
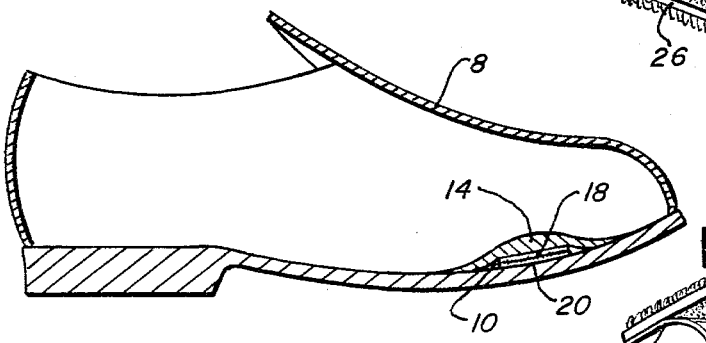
FIG. 3 is the same view as in FIG. 2 but of the separable fastener device adapted for use with a metatarsal support device.
Figure 4:
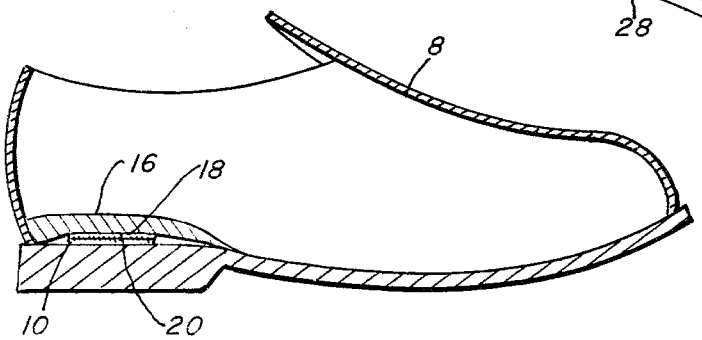
FIG. 4 is the same view as in FIG. 2 but of the separble fastener device adapted for use with a heel lift device.

The drawings illustrate a separable fastener device 10 adapted for use in securing a removable foot support device, including but not limited to an arch support 12 as viewed in FIGS. 1 and 2, a metatarsal support 14 as viewed in FIG. 3 and a heel lift 16 as viewed in FIG. 4, to an internal portion of shoe 8.

The separable fastener device 10 is comprised of first and second engaging elements 18 and 20, respectively. First engaging element 18 is affixed to a foot support device such as arch support 12 in FIG. 1 and second engaging element 20 is affixed to an internal portion of shoe 8. Releasably interengageable mating surfaces 22 and 24 of first engaging and second engaging elements 18 and 20, respectively, when pressed together as seen in FIGS. 2, 3 and 4, secure the foot support devices from slippage within shoe 8. These support devices may be removed by pulling on the foot support device thereby disengaging mating surfaces 22 and 24.

Figure 5:
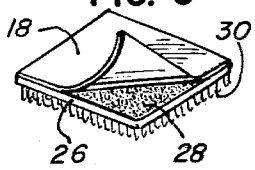
FIG. 5 is a perspective view of an engaging element of the separable fastener device.
Figure 6:
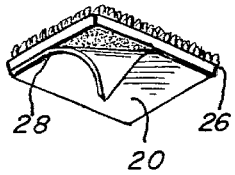
FIG. 6 is a perspective view of another engaging element of the separable fastener device.

First and second engaging elements 18 and 20, respectively, are comprised of flexible planar base sheets 26 as seen in FIGS. 5 and 6. Base sheets 26 are composed of a resilient material such as plastic. Base sheet 26 can be manufactured into any shape; however, a preferred embodiment base sheet 26 is generally rectangular. The rectangular shape has an economical production cost.

First engageable element 18 and second engageable element 20 are affixed respectively to a shoe support device and an internal portion of shoe 8. These engageable elements are affixed by base sheet 26 having a side providing attaching means such as pressure responsive adhesive 28 as seen in FIGS. 5 and 6.

Mating surfaces 22 and 24 may provide numerous combinations of compatible mechanical engaging elements such as hooks, loops and loosely matted threads. The preferred embodiment in this invention provides first engaging element 18 with a plurality of generally flexible hook members 30 formed of a plastic material as seen in FIG. 5. Hook members 30 project generally perpendicular to base sheet 26 and are closely spaced over at least a substantial portion of base sheet 26. Second engaging element 20 provides a mating surface 24 of a loosely arranged mat of interlocking hair-like threads 32 generally formed of a plastic material as seen in FIG. 6. Thus, when first and second engaging elements 18 and 20 respectively are pressed together as viewed in FIGS. 2, 3 and 4, hook members 30 and interlocking hair-like threads 32 mechanically engage. This mechanical engagement prevents slippage of the foot support device within shoe 8. The foot support device may be easily removed when desired by applying a force to the foot support device to cause yielding of the flexible hook members 30 thereby disengaging hook members 30 from interlocking hair-like threads 32.

The above detailed description has been given for ease of understanding only. No unnecessary limitations are to be understood therefrom as modifications will be obvious to those skilled in the art.

What is claimed is:

1. A separable fastener device adapted for use in securing a removable foot support device to an internal portion of a shoe comprising: first and second engaging elements, said elements being flexible planar sheets, said first element having a surface providing a means for attaching said first element to said removable foot support device, said second element having a surface bearing pressure responsive adhesive for attaching said second element to said internal portion of said shoe, said first and second elements each having another side providing releasably interengageable mating surfaces wherein said mating surfaces engage upon pressing together said surfaces and release upon pulling said surfaces apart.

2. A separable fastener device in accordance with claim 1 wherein said attaching means of each of said first and second engaging elements is a pressure responsive adhesive.

3. A separable fastener device in accordance with claim 1 wherein each of said flexible planar sheets is generally rectangular.

4. A separable fastener device in accordance with claim 1 wherein said mating surface of said first engaging element includes a plurality of generally flexible hook members projecting generally perpendicular to said sheet and closely spaced over at least a substantial portion of said sheet.

5. A separable fastener device in accordance with claim 4 wherein said hook members are formed of a plastic material.

6. A separable fastener device in accordance with claim 1 wherein said mating surface of said second engaging element includes a loosely arranged mat of interlocking hair-like threads.

7. A separable fastener device in accordance with claim 6 wherein said threads are formed of a plastic material.

8. A separable fastener device adapted for use in securing a removable foot support device to an internal portion of a shoe comprising:

a first engaging element including a generally rectangular flexible planar base sheet of resilient material wherein said sheet has a pressure responsive adhesive disposed on one side thereof whereby when said sheet is attached to said foot support device another side of said base sheet is exposed, said other side including a plurality of hook members comprising hooks of generally flexible resilient material formed of a plastic material, said hooks projecting generally vertically from said sheet;

a second engaging element including a generally rectangular flexible planar base sheet of resilient material wherein said sheet has a pressure responsive adhesive disposed on one side thereof whereby when said sheet is attached to said internal portion of said shoe another side of said base sheet is exposed, said other side including a loosely arranged mat of interlocking hair-like threads formed of a plastic material, whereby said second engaging element when positioned on said internal portion of a shoe contacts said first engaging element when said foot support device is disposed in said shoe, said hook members engaging said mat of interlocking hair-like threads to prevent slippage of said foot support device yet permitting removal of said foot support device from said shoe by application of a force to said foot support device to cause yielding of said hook members and thereby disengage said hook members from said mat.

* * * * *